US007159869B2

(12) United States Patent
Pastirik

(10) Patent No.: US 7,159,869 B2
(45) Date of Patent: Jan. 9, 2007

(54) FIVE CARD HIGH-LOW WAGERING GAMES AND METHODS THEREOF

(76) Inventor: Dennis J. Pastirik, 1609 Queen Victoria St. #103, Las Vegas, NV (US) 89144

( * ) Notice: Subject to any disclaimer, the term of this patent is extended or adjusted under 35 U.S.C. 154(b) by 250 days.

(21) Appl. No.: 10/993,838

(22) Filed: Nov. 22, 2004

(65) Prior Publication Data

US 2006/0108735 A1 May 25, 2006

(51) Int. Cl.
*A63F 3/08* (2006.01)

(52) U.S. Cl. ..... 273/274; 273/292

(58) Field of Classification Search ..... 273/274, 273/292

See application file for complete search history.

(56) References Cited

U.S. PATENT DOCUMENTS 4,651,997 A * 3/1987 Wood ..... 273/274
5,791,651 A * 8/1998 Bryant ..... 273/274
6,182,969 B1 2/2001 Green
6,406,020 B1 * 6/2002 Reed ..... 273/274
6,406,024 B1 * 6/2002 Perkins ..... 273/292
6,457,715 B1 10/2002 Friedman
2002/0135129 A1 * 9/2002 Tarantino ..... 273/292
2002/0185815 A1 12/2002 Regos
2002/0190470 A1 12/2002 Alaeddin

* cited by examiner

*Primary Examiner*—Eugene Kim
*Assistant Examiner*—Dolores R. Collins
(74) *Attorney, Agent, or Firm*—Harry M. Weiss; Weiss & Moy, P.C.

(57) ABSTRACT

A method of playing a five card high-low wagering game comprises distributing one first pair of playing cards and a single playing card of at least one three playing card hand of at least one deck of playing cards to an evens portion having a first bet and an odds portion having a second bet of the game. A fourth playing card distributed from the deck provides a second pair of playing cards pairing with the single playing card. The first bet and the second bet are separately settled depending upon the face value of a fifth playing card of the deck when compared to the face value of each playing card of both of the first and second pair of playing cards. Both a gaming table layout and gaming machine of the five card high-low wagering game is disclosed.

9 Claims, 4 Drawing Sheets

FIVE CARD HIGH-LOW WAGERING GAMES AND METHODS THEREOF

FIELD OF THE INVENTION

This invention relates generally to high-low wagering games and methods, and, more specifically, to improved five card high-low wagering games suitable for casino table play and gaming machine play and methods thereof.

BACKGROUND OF THE INVENTION

In the past a number of high-low (alternatively termed in-between) games have been played. One well-known game of this kind is called Acey-Deucey. In Acey-Deucey at least one player is dealt two playing cards from a deck of playing cards. The at least one player places a wager on whether a third playing card dealt from the remaining playing cards of the deck will have a rank that lies between the rank of the two playing cards previously dealt to the at least one player. A set of pre-determined rules dictates pay-outs and winning hands for the at least one player after the third card is dealt. After a period of time, generally, the at least one player loses interest in the game because of the lack of variety and lack of skill necessary to succeed in such a game, especially when the at least one player has a losing streak.

Green, U.S. Pat. No. 6,182,969 disclosed a blackjack wagering game, which has all the elements of blackjack with a side bet feature related to the dealing of two playing cards to the player and whether a third playing card that is dealt has a rank between the first two cards that were dealt. Green's, U.S. Pat. No. 6,182,969 game method has more interesting features to capture the interest of players. Similarly, Perkins, U.S. Pat. No. 6,406,024 disclosed an in-between card game, which includes two rounds of play for three playing cards dealt to from one to seven players and a dealer. In Perkins, U.S. Pat. No. 6,406,024, players win when the first card dealt to the dealer lies between the first two playing cards dealt to the player, while the cumulative value of all three playing cards in the player's hands versus the dealer's hand determines the win. Once again, the game disclosed in Perkins, U.S. Pat. No. 6,406,024 has more interesting features and opportunities for winning. Friedman, U.S. Pat. No. 6,457,715 disclosed another variant on an in-between game in which a player places a wager and is then dealt two playing cards which optionally may either be replaced with zero, one or two other playing cards, followed by the dealer exposing an additional playing card and resolving wagers according to predetermined relationships between each of the player's playing cards and additional exposed playing cards. Friedman, U.S. Pat. No. 6,457,715 disclosed a number of variations of this game including the use of indicia (such as dice) rather than playing cards. In yet another high-low game, Tarantino, U.S. Publication US 2002/0135129 A1 disclosed a machine generated game in which a player bets on the outcome of drawing one playing card compared to a second playing card in terms of whether the first playing card will be higher or lower in rank than the second playing card. According to the disclosure of Tarantino, U.S. Publication US 2002/0135129 A1, on a successful outcome for the player, a third playing card is compared to the second playing card, and so on, with other variations of the game being possible. All of these games incorporate some features of an Acey-Deucey game together with other well-known playing card games such as blackjack, poker or baccarat with greater wagering options and variations to increase interest in the subject game.

The present inventor provides an improved game which deviates less from a standard Acey-Deucey game and requires player skills as well as providing multiple opportunities for wagering. The present inventor's game is simple to understand by players and yet provides sufficient playing variability where skill-oriented choices in addition to increased winning opportunities maintain players' long term interest. Additionally, a house (otherwise termed a bank or owner of the game) is provided with greater possibility for control of payouts in the game by deciding the rules of the game and therefore the amount of house profitability.

SUMMARY OF THE INVENTION

Accordingly, it is an object of this disclosure to provide an improved five card high-low wagering game suitable for casino table play.

It is a further object of this disclosure to provide an improved five card high-low wagering game suitable for gaming machine play.

It is a still further object of this disclosure to provide a casino gaming table layout for an improved five card high-low wagering games suitable for casino table play.

It is a further object of this disclosure to provide a screen layout of a gaming machine for an improved five card high-low wagering game.

It is a yet further object of this disclosure to provide a method for playing an improved five card high-low wagering game suitable for casino table play.

It is a still further object of this disclosure to provide a method for playing an improved five card high-low wagering game suitable for gaming machine play.

PREFERRED EMBODIMENTS OF THE INVENTION

In accordance with one embodiment of this invention, a high-low wagering game method is disclosed. The method comprises the step of providing a five card high-low wagering game comprising dealing means, at least one player, at least one deck of playing cards containing a plurality of playing cards, and at least one region comprising at least one evens portion and at least one odds portion for the at least one player. The method further comprises the steps of placing at least a first bet in the evens portion and at least a second bet in the odds portion by the at least one player, distributing by the dealing means at least one three playing card hand from the at least one deck to the at least one player and selecting by the at least one player a pair of playing cards of the at least one three playing card hand and then assigning the selected pair of playing cards to only one of the evens portion and the odds portion thereby completely providing the pair of playing cards to only one of the evens portion and the odds portion. The method further comprises the steps of assigning by the at least one player a remaining third playing card of the at least one three playing card hand to the other remaining one of the evens portion and the odds portion that does not have the pair of playing cards of the at least one three playing card hand, distributing to the at least one player a fourth card from the deck for pairing the fourth card with the remaining third card thereby providing both a first pair of playing cards for the evens portion and a second pair of playing cards for the odds portion and distributing and assigning a fifth card from the at least one deck to the dealing means. The method further comprises the steps of comparing a face value of the fifth card to a face value of both of the first paired playing cards of the evens portion of the at least one player, separately comparing the face value of the fifth card to a face value of both of the second paired playing cards of the odds portion of the at least one player, and settling the first bet of the evens portion of the at least one player and separately settling the second bet of the odds portion of the at least one player according to at least one high-low wagering game rule depending upon the face value of the fifth playing card as compared to the face value of each one of both of the first and second pair of playing cards.

In accordance with a second embodiment of this invention, a gaming table layout is disclosed. The layout comprises, in combination, a five card high-low wagering game comprising a dealer location, at least one player location and a region of the gaming table layout for the at least one player location, the region including an evens portion provided for a first bet, an odds portion provided for a second bet and an odds pays table having at least one odds pays line. The layout further comprises a bank portion and a dealer playing card portion of the dealer location including at least one deck of playing cards. The dealer playing card portion of the layout provides for distribution of at least one three card playing card hand from the at least one deck of playing cards to the at least one player location, and the bank portion provides for settlement of the first bet of the evens portion and separately settlement of the second bet according to the at least one odds pays line of the odds pays table.

In accordance with a third embodiment of this invention, a gaming machine is disclosed. The gaming machine comprises, in combination, a five card high-low wagering game comprising a screen of the gaming machine, means for generating a plurality of playing cards, the screen including at least one player portion having at least one three playing card hand of the plurality of playing cards, at least one even money portion and at least one odds portion and a dealer portion, and a player selection means located on a portion of the gaming machine. The screen comprises at least one even money portion of the screen comprising a first at least two playing card placeholder for displaying one of a selected single playing card and a pair of playing cards distributed from the at least one three playing card hand and at least one bet of the at least one even money portion. The screen further comprises at least one odds portion of the screen comprising a second at least two playing card placeholder for displaying one of a selected single playing card and a pair of playing cards distributed from the at least one three playing card hand and at least one bet of the at least one odds portion.

The foregoing and other articles, features, and advantages of the invention will be apparent from the following more detailed description of the preferred embodiments of the invention, as illustrated in the accompanying drawings.

DESCRIPTION OF THE INVENTION

Figure 1:
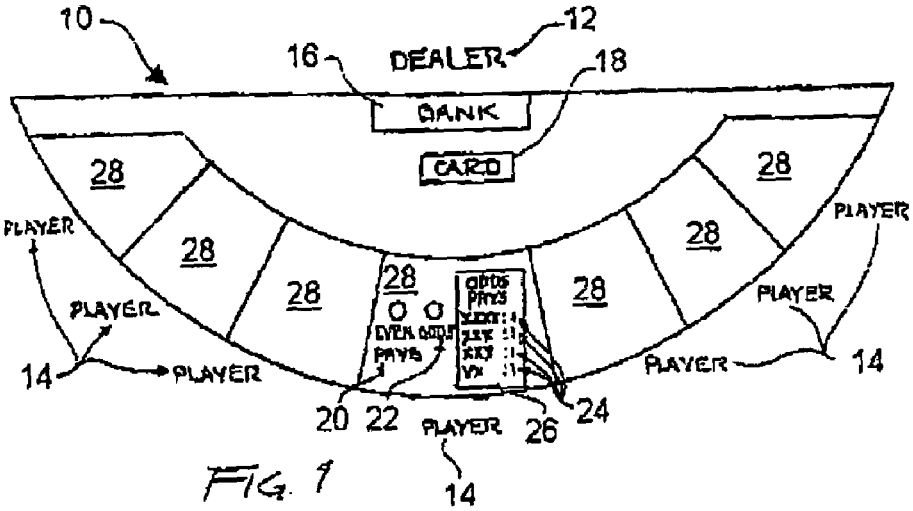
FIG. 1 is a gaming table layout for a casino gaming table according to one embodiment of the present invention.

According to FIG. 1, a casino gaming table layout 10 of one embodiment according to the present invention comprises, in combination a five card high-low wagering game comprising a dealer location 12 (FIG. 1 shows DEALER) and a plurality of player locations 14 (FIG. 1 shows each one as PLAYER) defined by a region 28 of the table layout 10 for each one of the plurality of player locations 14. The table layout 10 further comprises a bank portion 16 (FIG. 1 shows BANK) and a dealer playing card portion 18 (FIG. 1 shows CARD) proximate to the dealer location 12. The region 28 for each one of the plurality of player locations 14 of the table layout 10 further comprises an evens portion 20 (FIG. 1 shows EVEN PAYS), an odds portion 22 (FIG. 1 shows ODDS), at least one odds pays line 24 in an odds pays table 26 (FIG. 1 shows ODDS PAYS). In the casino gaming table layout 10 at least one three playing card hand (not shown in FIG. 1) is initially dealt by a dealer from at least one deck of playing cards (not shown) to each region 28 of each one of the plurality of player locations 14 from the dealer location 12. It is understood that more than one deck of playing cards may be used by the dealer to deal playing cards to a player of each one of the plurality of player locations 14. In one embodiment the evens portion 20 has an even money bet (for example, in the evens portion 20, if the player wins, an even money bet of $10 would return $10 plus the original $10 bet), while the odds portion 22 has an odds bet, representing a potentially higher return to the player than the even money bet (for example, in the odds portion 22, if the player wins, an odds bet of $10 may return $100 plus the original $10 bet).

Figure 2:
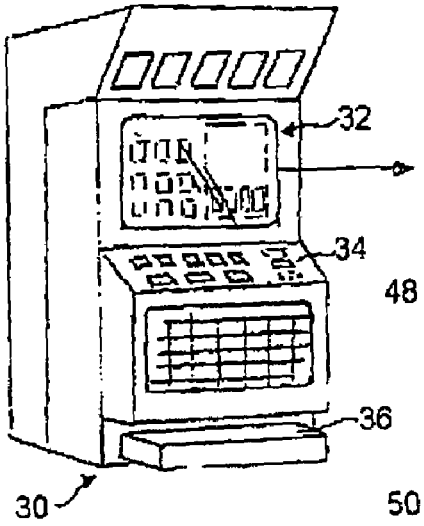
FIG. 2 is a front perspective view showing a portion of a gaming machine according to a second embodiment of the present invention.

Referring to FIG. 2, a gaming machine 30 of one embodiment of a five card high-low wagering game according to the present invention is depicted. The gaming machine 30 comprises, in combination, a five card high-low wagering game, means for generating a plurality of playing cards (not shown) and comprising a screen 32 (see FIG. 3) showing various details of one embodiment of a five card high-low wagering game similar to the previously described casino game table layout 10 (see above). It is understood that the means for generating a plurality of playing cards comprises at least a central processing unit such as a random number generator. The gaming machine 30 further comprises a player selection means located on a portion 34 of the gaming machine 30 comprising at least one of at least one bet placing actuator, at least one number of hands to play selector, at least one dealing actuator, at least one playing card manipulator, at least one hands re-deal actuator, and at least one currency equivalent receiver (not shown) for receiving currency equivalents. It is understood that currency equivalents received by the currency equivalent receiver means money such as currency notes and coins, redemption slip and redemption card, credit and debit card, and the like. It is understood that a portion of the screen 32 may comprise the player selection means located on a portion 34 of the gaming machine 30, with the player activating a selection by touching the screen 32. The player selection means of the portion 34 may be an actuator comprising at least one of a plurality of buttons, a plurality of membranes, a touch sensitive screen and a voice activated portion and the like. The gaming machine 30 further comprises a receptacle 36 receiving at least one currency equivalent, such currency equivalent including currency, a redemption slip and a redemption card, and the like. It is understood that in a computer game embodiment of the gaming machine 30, the features of the gaming machine 30 may be altered to provide different means for player data entry. For example, in another embodiment of the gaming machine 30 comprising a computer game, a player may use a mouse pointer, a tablet, voice activation and the like, and further, instead of currency and equivalents thereof, a player may be awarded point values.

Figure 3:
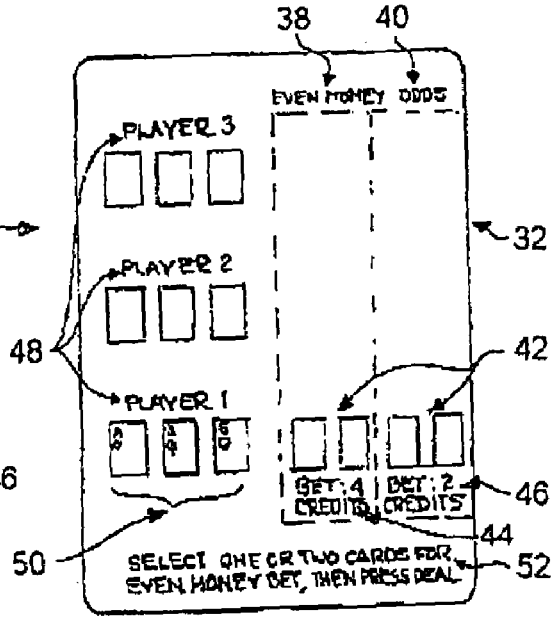
FIG. 3 is an exploded view of a portion of a screen of the gaming machine of FIG. 2 according to the second embodiment of the present invention.

Referring to FIG. 3, an exploded view of a portion of the screen 32 of the gaming machine 30 of FIG. 2 is shown. The screen 32 comprises an even money portion 38 (shown as EVEN MONEY in FIG. 3) and an odds portion 40 (shown as ODDS in FIG. 3). The even money portion 38 of the screen 32 further comprises a first at least two playing card placeholder 42 and a current even money bet 44 (FIG. 3 shows BET: 4 CREDITS) of the even money portion 38. The odds portion 40 of the screen 32 further comprises a second at least two playing card placeholder 42 and a current odds bet 46 (FIG. 3 shows BET: 2 CREDITS) of the odds portion 40. The screen 32 further comprises at least one player portion 48 (FIG. 3 shows PLAYER 1, PLAYER 2 and PLAYER 3) with each player portion 48 having at least one three playing card hand 50 (FIG. 3 shows an ace of diamonds, a three of clubs and a five of hearts for PLAYER 1). As described (see below) with reference to the flow diagram of FIG. 4, each player portion 48 corresponds to at least three playing cards dealt by a dealer from a deck of playing cards of a casino five card high-low wagering game. The screen 32 further comprises an instructions portion 52 (FIG. 3 shows SELECT ONE OR TWO CARDS FOR EVEN MONEY BET, THEN PRESS DEAL) providing a player of the gaming machine 30 guidance regarding steps to be taken to play at least one embodiment of a five card high-low wagering game. The screen 32 of the gaming machine further comprises a dealer portion (not shown) for displaying at least one playing card of the plurality of playing cards and at least one current credits portion for displaying the number of credits (not shown) available to a player for playing the five card high-low wagering game.

Exemplary Methods of Playing a Five Card High-Low Wagering Game:

1. Casino Five Card High-Low Wagering Game.

Figure 4:
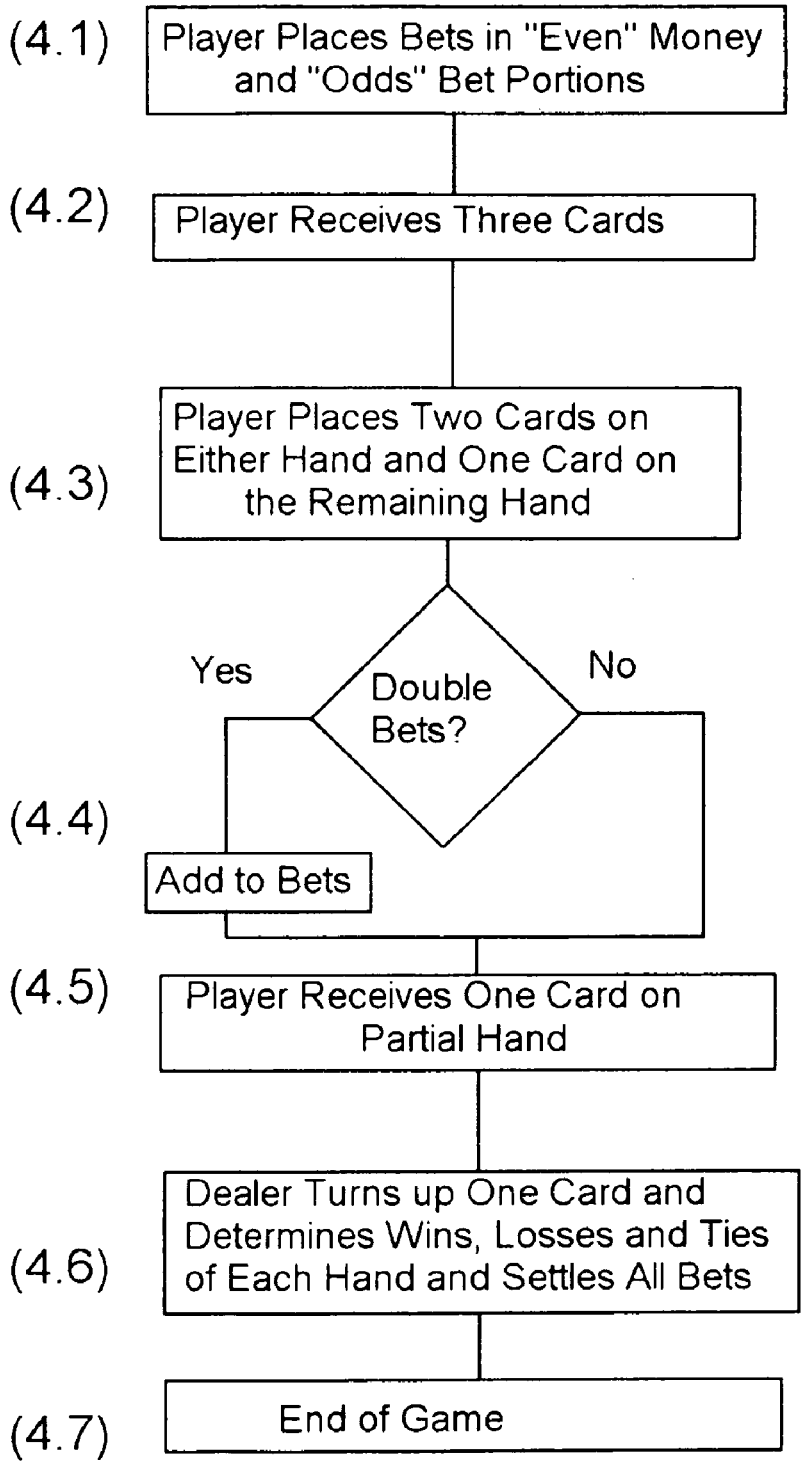
FIG. 4 is a flow diagram showing an example of the method of play according to an embodiment of the present invention.

Referring to FIG. 4 in one embodiment of a casino five card high-low wagering game, the method comprises, in a first step (4.1), each player located at each one of the plurality of player locations 14 of the table layout 10 placing initial bets in the evens portion 20 and in the odds portion 22 of the region 28 of each player located at each one of the plurality of player locations 14. In step (4.2), the method comprises each player located at each one of the plurality of player locations 14 receiving at least one three playing card hand of the deck of playing cards from the dealer and in step (4.3), each player selecting a first pair of playing cards of the at least one three playing card hand and then assigning the selected first pair of playing cards to either of the evens portion 20 or to the odds portion 22 of the table layout 10 and assigning the remaining (third) unpaired playing card of the at least one three playing card hand to the remaining evens portion 20 or alternatively odds portion 22 that does not have the first pair of playing cards of the at least one three playing card hand. For example, if the first pair of playing cards selected is assigned to the evens portion 20, then the remaining (third) unpaired playing card is assigned to the odds portion 22 by default. In step (4.4), (FIG. 4 shows a YES/NO decision tree) the method comprises each player selectively increasing bets (FIG. 4 shows Double Bets?). It is understood that each player may increase bets (step (4.4) of FIG. 4 shows Add to Bets) based on the rank (also termed face value) of the previously drawn playing cards and risk tolerance of each player. It is understood that doubling bets is one option of numerous options such as tripling bets and the like. In step (4.5), the method comprises the dealer located at the dealer location 12 dealing a fourth playing card from the deck to each player to pair up with the remaining (third) unpaired playing card of each player thereby providing a second pair of playing cards. It is understood that yet another option for increasing bets may occur after step (4.5). In step (4.6), the method comprises the dealer dealing a fifth playing card from the deck to the dealer and the dealer comparing the rank (face value) of the fifth playing card to the rank (face value) of each of the either first or second paired playing cards assigned to the evens portion 20 and separately to either the first or second paired playing cards assigned to the odds portion 22 by each player. According to at least one of a predetermined set of rules for wins and losses (see below), the method further comprises the dealer settling bets for each one of the evens portion 20 and separately settling bets for each one of the odds portion 22 with each player located at each one of the plurality of player locations 14, depending upon the face value of the fifth playing card as compared to the face value of each one of both of the first and second pair of playing cards.

In step (4.7) the method comprises ending the game and if desired, repeating the sequence starting from step (4.1), as described above.

2. Gaming Machine Five Card High-Low Wagering Game.

Figure 5A:
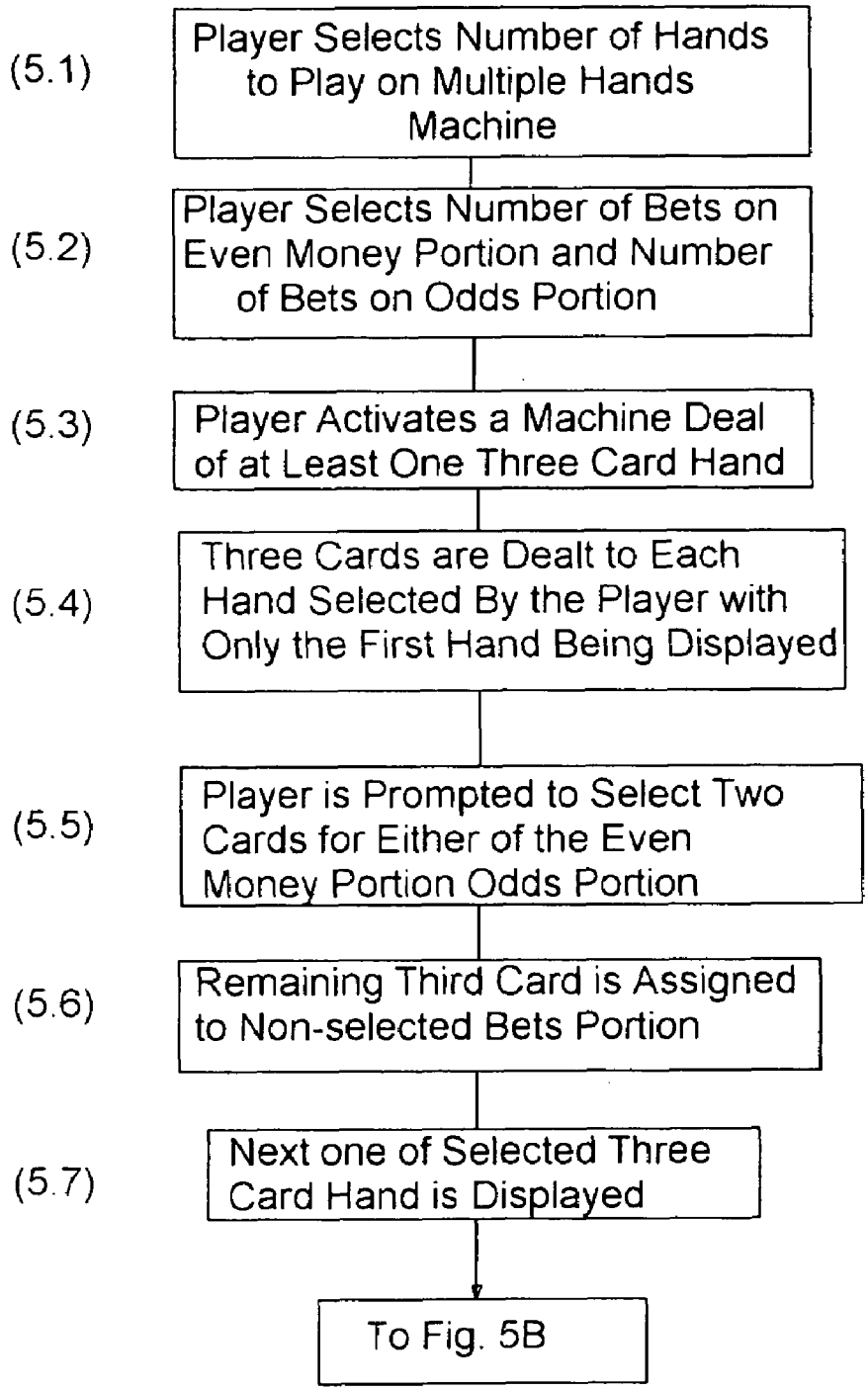
FIG. 5A is a flow diagram showing a first portion of the method of play according to another embodiment of the present invention.
Figure 5B:
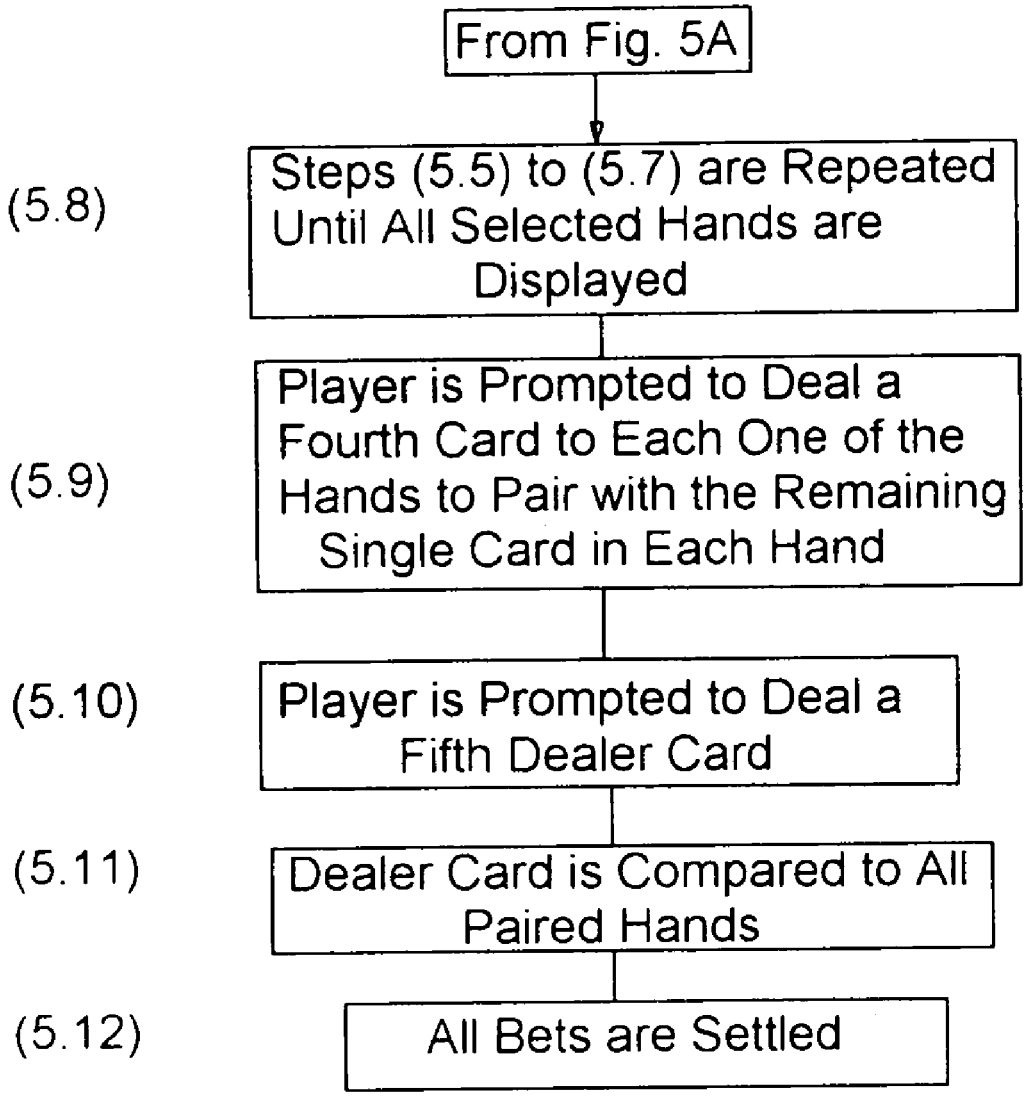
FIG. 5B is a flow diagram showing a second portion of the method of play according to the embodiment of FIG. 5A of the present invention.

Referring to both FIG. 5A and FIG. 5B, in one embodiment of a gaming machine five card high-low wagering game, in a first step (5.1), the method comprises at least one player selecting at least one three playing card hand 50 of a plurality of playing cards of at least one player portion 48 of the screen 32 of the gaming machine 30 of FIG. 2, and in step (5.2) at least one player selecting a total bet (alternatively designated a total number of credits) for each at least one three playing card hand 50 of the plurality of playing cards. It is understood that the plurality of playing cards may be indicia, with the indicia corresponding to one or a multiplicity of decks of playing cards having at least one suit, such as spades, clubs, diamonds and hearts having a plurality of playing cards with ascending playing card face values, such as thirteen ranks (face values) ranging from deuce to ace (deuce being the lowest value, and other card face values increasing from three, four and so on, to ten, jack, queen, king, with ace having the highest face value) and the like. Alternatively, the indicia may comprise dice faces or any set of ordered ascending numbers. According to step (5.2), the method further comprises assigning a bet 44 to the even money portion 38 and a bet 46 to the odds portion 40 of the screen 32 of the gaming machine 30. It is understood that different bets may be assigned to the bet 44 of the even money portion 38 and to the bet 46 of the odds portion 40 of the screen 32 of the gaming machine 30, with the amount of a permissible bet being pre-determined. Preferably, the permissible bet 44 of the even money portion 38 is greater then the permissible bet 46 of the odds portion 40, since the bet 44 of the even money portion 38 only pays out 1:1 (that is, 10 credits returns 10 credits plus the original 10 credits in a win), whereas the bet 46 of the odds portion 40 pays out a multiplied value of the bet 46 such as 10:1 (that is, in a win, 10 credits may return 100 credits plus the original 10 credits). It is understood that there must be at least one bet 44 for the even money portion 38 and at least one bet 46 for the odds portion 40. In step (5.3), the method comprises the at least one player activating the player selecting portion 34 (or a portion of the screen 32) of the gaming machine 30 thereby dealing at least one three playing card hand 50 of the plurality of playing cards and in step (5.4), the method further comprises displaying at least one three playing card hand 50 of the plurality of playing cards on the screen 32 of the gaming machine 30. In step (5.5), the method comprises the player assigning one pair of playing cards of the at least one three playing card hand 50 of the plurality of playing cards to one of the at least two playing card placeholder 42 of the even money portion 38 and the at least two playing card placeholder 42 of the odds portion 40 of the screen 32 of the gaming machine 30. In step (5.6), the method comprises assigning the remaining (third) unpaired playing card of the at least one three playing card hand 50 to one of the at least two playing card placeholder 42 of the screen 32 of the gaming machine 30 that does not have the pair of playing cards of the at least one three playing card hand. For example, if the pair of playing cards is assigned by the at least one player to the even money portion 38 of the screen 32, the unpaired remaining (third) unpaired playing card is automatically assigned to the odds portion 40 of the screen 32 of the gaming machine 30. In step (5.7), the method comprises displaying a second at least three playing card hand 50 of the plurality of playing cards on the screen 32. It is understood that in a different embodiment, additional bets may be placed by the at least one player after dealing each at least three playing card hand 50 of the plurality of playing cards and after assigning the pair of playing cards and the remaining (third) unpaired playing card of each at least three card hand 50 to one of the even money portion 38 and the odds portion 40 of the screen 32. In step (5.8), the method comprises repeating above-mentioned steps (5.5) to (5.7) for the second at least three playing card hand 50 of the plurality of playing cards and any subsequent at least three playing card hand 50 thereby displaying each of the at least three playing card hand 50 for each at least one player portion 48 of the screen 32 of the gaming machine 30. In step (5.9), the method further comprises the at least one player activating the gaming machine 30 and dealing a fourth playing card to pair with the remaining (third) unpaired playing card of each at least three playing card hand 50, and in step (5.10) the method further comprises the at least one player activating the gaming machine 30 again and dealing and displaying a fifth playing card (also termed the dealer card) on the dealer portion (not shown) of the screen 32. In step (5.11) the method comprises comparing the rank (face value) of the fifth playing card (dealer playing card) to the rank (face value) of each of both of the paired playing cards for each at least one player portion 48 on the screen 32 of the gaming machine 30 and in step (5.12), settling bets for each one of the even pays portion 38 and settling bets for each one of the odd pays portion 40 for each at least one player portion 48 on the screen 32 of the gaming machine 30 according to a predetermined set of rules for wins and losses, depending upon the face value of the fifth playing card as compared to the face value of each one of both of the pairs of playing cards.

Exemplary Rules of a Five Card High-Low Wagering Game:

1. Casino Five Card High-Low Wagering Game.

In one embodiment of how payouts are determined and separately settled by the dealer at each one of the evens portion 20 or the odds portion 22, a player at each one of the plurality of player locations 14 wins if the rank (face value) of the dealer playing card is between the rank (face value) of the paired playing cards assigned to either one of the evens portion 20 or separately the odds portion 22, but loses if the rank (face value) of the dealer playing card is less than the rank (face value) of the lowest ranked card of the paired playing cards assigned by the player to either one of the evens portion 20 or separately to the odds portion 22. Additionally, the player at each one of the plurality of player locations 14 loses if the rank (face value) of the dealer playing card is equal to the rank (face value) of one playing card of the paired playing cards assigned by the player to either one of the evens portion 20 or the odds portion 22. Additionally, the player at each one of the plurality of player locations 14 loses if the rank (face value) of the dealer playing card is greater than the rank (face value) of the highest ranked playing card of the paired playing cards assigned by the player to either one of the evens portion 20 or the odds portion 22.

As stated above, a bet in the evens portion 20 returns 1:1 for a win, whereas a bet in the odds portion 22 returns a multiplied value of the bet in the odds portion 22 for a win. The multiplied value of the bet in the odds portion for a win comprises at least one of a winning pair of cards combination in the odds portion 22 of each player at each one of the plurality of player locations 14. As stated above, each player at each one of the plurality of player locations 14 may assign any combination of a pair of playing cards of at least one three playing card hand to either the even money portion 20 or to the odds portion 22. However, in a preferred assignment, a paired playing card combination of an ace and a deuce may only be assigned to the evens portion 20.

The dealer may settle a bet with a winning bonus to at least one player when the face value of the fifth playing card as compared to the face value of a first and second playing card of a pair of playing cards of the odds portion 22 is sequential, with the face value of the fifth playing card being one face value less than the highest face value of the first and second playing cards of the odds portion 22 and the face value of the fifth playing card being one face value greater than the lowest face value of the first and second playing cards of the odds portion 22. In a first example, a winning combination comprises a paired playing card combination where the player paired playing cards are same suited ace and queen, and the dealer playing card has a same suited king thereby providing a three playing card combination of same suited ace, king and queen. For illustration, if the ace of spades and the queen of spades are paired by the player and the dealer has the king of spades, the player may receive a multiplied (bonus) odds win valued at odds of 1000:1. It is understood that the multiplied odds win may be any suitable casino predetermined value and may be altered. In a second example, a winning combination comprises one of a non-suited and a suited paired playing card combination where the player paired playing cards are ace and queen, and the dealer playing card has a differently suited king thereby providing a three playing card combination of non-suited ace, king and queen. This second example of a winning combination may provide the player with a multiplied odds win of lesser value than the first example of a winning combination (see above) since there are more ways in which the player may win.

In a third example, a winning combination comprises a same suited paired playing card combination where the player paired playing cards are deuce and four, and the dealer playing card has a same suited three thereby providing a three playing card combination of same suited deuce, three and four. The multiplied (bonus) odds win of the third example of a winning combination may be the same as for the first example of a winning combination (see above). In a fourth example, a winning combination comprises one of a non-suited and a suited paired playing card combination where the player paired playing cards are deuce and four, and the dealer playing card has a differently suited three thereby providing a three playing card combination of non-suited deuce, three and four.

In a fifth example, a winning combination comprises a paired playing card combination where the player paired playing cards are same suited ace and deuce, and the dealer has a same suited playing card with a rank (face value) less than the same suited ace and greater than the same suited deuce. It is understood that a winning combination may further comprise a similar non-suited version of the fifth example (see above) wherein the player paired playing cards are an ace and deuce and the dealer playing card has a playing card with a rank (face value) less than the ace and greater than the deuce, and at least one playing card is of a different suit to the remaining two playing cards. In the fifth example of a winning combination the multiplied odds win may be significantly lower than the first example to fourth example because the likelihood of the rank of the dealer playing card being between the ranks of the player paired combination playing cards of the ace and the deuce is maximized.

In a sixth example, a winning combination comprises a paired playing card combination where the rank of the player paired playing cards is at least two values apart. For illustration, if the player paired playing cards are four and seven, and the dealer playing card is a five or a six, the player has a winning combination, with a greater multiplied odds win compared to the fifth example (see above). In another illustration, the player paired playing cards are a seven and a queen, and the dealer playing card is a ten, thereby providing the player with a winning combination with a reduced multiplied odds win compared to the previous illustration since the difference between the rank of the seven and the rank of the queen is greater than the difference between the rank of the four and the rank of the seven of the previous illustration (see above).

2. Gaming Machine Five Card High-Low Wagering Game.

The description for exemplary rules of a Gaming Machine Five Card High-Low Wagering Game is similar to exemplary rules of the Casino Five Card High-Low Wagering Game (see above), with appropriate substitution of references from a bet in the evens portion 20 of the casino gaming table layout 10 to one of the even money portion 38 of the screen 32 of the gaming machine 30, and similarly, the odds portion 22 of the casino gaming table layout 10 to the odds portion 40 of the screen 32 of the gaming machine 30. Winning combinations may be defined similarly in both the casino gaming table layout 10 and the gaming machine 30 (see above).

While the invention has been particularly shown and described with reference to preferred embodiments thereof, it will be understood by those skilled in the art that the foregoing and other changes in form and details may be made therein without departing from the spirit and scope of the invention.

What is claimed is:

1. A high-low wagering game method comprising the steps of:

providing a five card high-low wagering game comprising dealing means, at least one player, at least one deck of playing cards containing a plurality of playing cards, and at least one region comprising at least one evens portion and at least one odds portion for said at least one player;

placing at least a first bet in said evens portion and at least a second bet in said odds portion by said at least one player;

distributing by said dealing means at least one three playing card hand from said at least one deck to said at least one player;

selecting by said at least one player a pair of playing cards of said at least one three playing card hand and then assigning said selected pair of playing cards to only one of said evens portion and said odds portion thereby completely providing said pair of playing cards to only one of said evens portion and said odds portion;

assigning by said at least one player a remaining third playing card of said at least one three playing card hand to the other remaining one of said evens portion and said odds portion that does not have said pair of playing cards of said at least one three playing card hand;

distributing to said at least one player a fourth card from said deck for pairing said fourth card with said remaining third card thereby providing both a first pair of playing cards for said evens portion and a second pair of playing cards for said odds portion;

distributing and assigning a fifth card from said at least one deck to said dealing means;

comparing a face value of said fifth card to a face value of both of said first paired playing cards of said evens portion of said at least one player;

separately comparing said face value of said fifth card to a face value of both of said second paired playing cards of said odds portion of said at least one player; and settling said first bet of said evens portion of said at least one player and separately settling said second bet of said odds portion of said at least one player according to at least one high-low wagering game rule depending upon the face value of said fifth playing card as compared to the face value of each one of both of said first and second pair of playing cards.

2. The method according to claim 1 wherein said dealer means comprises at least one of a dealer and a gaming machine.

3. The method according to claim 1 further comprising the step of: placing at least one bet in at least one of said evens portion and said odds portion by said at least one player after distributing said at least one three playing card hand to said at least one player.

4. The method according to claim 1 further comprising the step of: placing at least one bet in at least one of said evens portion and said odds portion by said at least one player after distributing said fourth card to said at least one player.

5. The method according to claim 1 wherein said at least one deck comprising indicia corresponding to at least one playing card suit and said at least one playing card suit having a plurality of playing cards with ascending playing card face values.

6. The method according to claim 1 wherein said first bet of said even money portion exceeds said second bet of said odds portion.

7. The method according to claim 1 wherein said region comprises a screen of a gaming machine and said screen including one at least two playing card placeholder of said evens portion and one at least two playing card placeholder of said odds portion.

8. The method according to claim 7 wherein said gaming machine comprises a player selecting portion.

9. The method according to claim 1 wherein said region comprises a portion of a high-low wagering game table layout.

* * * * *